US010416580B2

(12) United States Patent
Shkuri et al.

(10) Patent No.: US 10,416,580 B2
(45) Date of Patent: Sep. 17, 2019

(54) METHOD AND APPARATUS FOR REDUCING CONTAMINATION IN LIQUID ELECTROPHOTOGRAPHIC PRINTING

(71) Applicant: HP INDIGO B.V., Amstelveen (NL)

(72) Inventors: Kobi Shkuri, Ness Ziona (IL); Sasi Moalem, Ness Ziona (IL); Reut Diamant, Ness Ziona (IL); Yossi Cohen, Rehovot (IL); Shahar Tal, Ness Ziona (IL)

(73) Assignee: HP Indigo B.V., Amstelveen (NL)

( * ) Notice: Subject to any disclaimer, the term of this patent is extended or adjusted under 35 U.S.C. 154(b) by 0 days.

(21) Appl. No.: 15/545,939

(22) PCT Filed: Apr. 1, 2015

(86) PCT No.: PCT/EP2015/000709

§ 371 (c)(1),
(2) Date: Jul. 24, 2017

(87) PCT Pub. No.: WO2016/155755

PCT Pub. Date: Oct. 6, 2016

(65) Prior Publication Data

US 2018/0017882 A1 Jan. 18, 2018

(51) Int. Cl.

| | |
|---|---|
| ***G03G 15/10*** | (2006.01) |
| ***G03G 5/082*** | (2006.01) |
| ***G03G 15/08*** | (2006.01) |
| ***G03G 21/00*** | (2006.01) |
| ***G03G 9/08*** | (2006.01) |

(52) U.S. Cl.

CPC ..... *G03G 5/08214* (2013.01); *G03G 9/0812* (2013.01); *G03G 15/0887* (2013.01); *G03G 15/0894* (2013.01); *G03G 15/10* (2013.01); *G03G 15/104* (2013.01); *G03G 21/0088* (2013.01); *G03G 21/0094* (2013.01); *G03G 2215/018* (2013.01)

(58) Field of Classification Search

CPC ..... G03G 5/08214
USPC ..... 399/159
See application file for complete search history.

(56) References Cited

U.S. PATENT DOCUMENTS 5,797,328 A 8/1998 Lippold et al.
6,781,612 B1 * 8/2004 Detig ..... B41J 2/4476 347/112

(Continued)

FOREIGN PATENT DOCUMENTS

WO WO 2011081230 A1 * 7/2011 ..... C10M 175/0058
WO WO-2011081230 A1 * 7/2011 ..... C10M 175/0058

OTHER PUBLICATIONS

CN-207645862-U; Zhou; clipped image and abstract as foreign reference (Year: 2018).*

(Continued)

*Primary Examiner* — Quana Grainger
(74) *Attorney, Agent, or Firm* — Dierker & Kavanaugh PC

(57) ABSTRACT

In an example of a method for reducing contamination, a purified imaging oil is formed by filtering an imaging oil through an imaging oil filter, and then filtering the imaging oil through a polar absorbent filter. A surface of an amorphous silicon photoconductor of a liquid electrophotographic printing apparatus is maintained by periodically applying the purified imaging oil to the amorphous silicon photoconductor.

15 Claims, 3 Drawing Sheets

(56) References Cited

U.S. PATENT DOCUMENTS

| | | | | |
|---|---|---|---|---|
| 7,010,259 | B2 | 3/2006 | Gila et al. | |
| 7,537,333 | B2 | 5/2009 | Kessler et al. | |
| 8,437,679 | B2 | 5/2013 | Wilde et al. | |
| 2004/0264985 | A1* | 12/2004 | Hamby | G03G 15/0855 399/30 |
| 2006/0029430 | A1* | 2/2006 | Hosoya | G03G 15/11 399/249 |
| 2006/0141379 | A1* | 6/2006 | Teramoto | G03G 5/08214 430/106.2 |
| 2006/0210315 | A1* | 9/2006 | Nakamura | G03G 15/104 399/237 |
| 2008/0131807 | A1 | 6/2008 | Teshima et al. | |
| 2012/0079955 | A1 | 4/2012 | Lam et al. | |
| 2014/0105648 | A1 | 4/2014 | Bachar et al. | |
| 2014/0212176 | A1 | 7/2014 | Berg | |
| 2016/0031733 | A1* | 2/2016 | Scheurer | C02F 1/72 210/758 |

OTHER PUBLICATIONS

Hiroyuki, K., "Chatter Vibration of a leaner Blade in Electrophotography", Journal of Imaging Science and Technology; No. 1; Jan./Feb. 1996.

* cited by examiner

METHOD AND APPARATUS FOR REDUCING CONTAMINATION IN LIQUID ELECTROPHOTOGRAPHIC PRINTING

BACKGROUND

The global print market is in the process of transforming from analog printing to digital printing. Inkjet printing and electrophotographic printing are two examples of digital printing techniques. Liquid electrophotographic (LEP) printing is an example of electrophotographic printing. LEP printing combines the electrostatic image creation of laser printing with the blanket image transfer technology of offset lithography. In one example of LEP printing, a charged liquid printing fluid is applied to a latent image on a photo imaging plate (i.e., photoconductor, photoconductive member, photoreceptor, etc.) to form a fluid image. The fluid image is electrostatically transferred from the photo imaging plate to an intermediate transfer member (which may be heated). At least some carrier fluid of the fluid image is evaporated at the intermediate transfer member to form a substantially solid film image. The solid film image is transferred to a recording medium.

BRIEF DESCRIPTION OF THE DRAWINGS

Features of examples of the present disclosure will become apparent by reference to the following detailed description and drawings, in which like reference numerals correspond to similar, though perhaps not identical, components. For the sake of brevity, reference numerals or features having a previously described function may or may not be described in connection with other drawings in which they appear.

DETAILED DESCRIPTION

Figure 1:
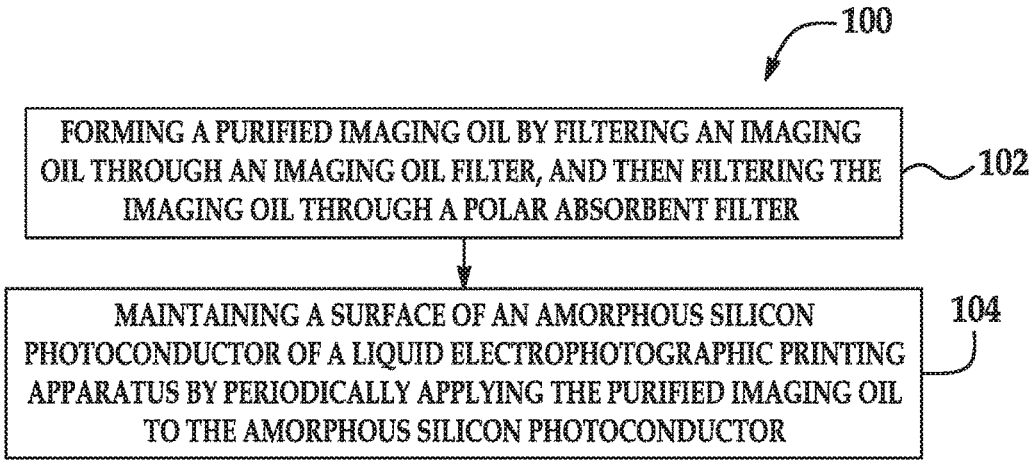
FIG. 1 is a flow diagram illustrating an example of a method for reducing contamination.

The liquid electrophotographic (LEP) printing apparatus disclosed herein includes an amorphous silicon photoconductor. The expected lifespan of the amorphous silicon photoconductor equates to millions of printing impressions or print cycles (e.g., from about 5,000,000 to about 7,000,000). The expected amorphous silicon photoconductor lifespan is at least an order of magnitude higher than the expected lifespan of organic photoconductors, which equates to hundreds of thousands of printing impressions or print cycles (e.g., 100,000 to about 400,000).

The present inventors have found, however, that the lifespan of the amorphous silicon photoconductor can be significantly and deleteriously affected by charging agents that are introduced to the amorphous silicon photoconductor during a cleaning process. For example, unfiltered imaging oil, or imaging oil filtered through an imaging oil filter alone includes residual polar molecules (e.g., charging agents) that are exposed to the amorphous silicon photoconductor during cleaning. During cleaning, when the introduced charging agents are combined with residual charging agents from a print or impression portion of the cycle, the level of charging agents on the amorphous silicon photoconductor increases. Upon completion of the cleaning, it has been found that some residual charging agents remain on the amorphous silicon photoconductor. When these residual charging agents are exposed to charging plasma during a subsequent print cycle, they polymerize and accumulate on the surface of the amorphous silicon photoconductor. Over time, this accumulation builds up on the surface of the amorphous silicon photoconductor.

The present inventors have found that the rate at which polymerized charge agents accumulate on the amorphous silicon photoconductor is much faster than the rate of accumulation on the organic photoconductor, and as a result, the amount and stickiness of the accumulation are much worse on the amorphous silicon photoconductor than on the organic photoconductor. These findings are surprising, in part because the amorphous silicon photoconductor is inorganic and the polymerized charge agent(s) had been expected to stick more readily to the organic photoconductor than to the inorganic photoconductor. Since the polymerized charging agent that is accumulating on the surface of the amorphous silicon photoconductor is charged (e.g., negatively), the lateral conductivity or the conductivity across the surface of the amorphous silicon photoconductor is increased. Polymerized charging agent accumulation on the amorphous silicon photoconductor has been found to reduce the surface resistivity of the amorphous silicon photoconductor. With a reduced surface resistivity, and thus a higher surface conductivity, the charges can move on the surface during the print cycle(s). Charge movement can create a blurred image in both the charged and discharged areas of the amorphous silicon photoconductor. As such, reduced surface resistivity significantly impacts the image quality of prints formed with the LEP printing apparatus including the amorphous silicon photoconductor.

After observing the amount and stickiness of the polymerized charging agent accumulation on a comparative amorphous silicon photoconductor treated with unfiltered imaging oil, the present inventors found the purified imaging oil disclosed herein to be unexpectedly effective in maintaining the cleanliness of the amorphous silicon photoconductor. For example, it has been found that by using the purified imaging oil, the surface resistivity of the amorphous silicon photoconductor is maintained at a high level over at least 750,000 print cycles, and up to millions of print cycles. The level of the surface resistivity may be evaluated through the resolution of the print that is formed. For example, a print formed using the amorphous silicon photoconductor having the high surface resistivity level has a resolution of at least 800 dpi (dots per inch). In the examples disclosed herein, over the lifespan of the amorphous silicon photoconductor, the print quality is consistently high (e.g., small dots, text, etc. can be printed over and over again with the high resolution of at least 800 dpi, minimal to no smearing, etc.).

The purified imaging oil disclosed herein is filtered consecutively through two different filters. The purified imaging oil is then applied to the amorphous silicon photoconductor during a cleaning portion of a print cycle, and prior to initiation of a subsequent print cycle. The purified imaging oil is substantially free of contamination (including charging agents), as evidenced by its low conductivity, ranging from about 0 pico mhos/cm up to 10 pico mhos/cm). When the purified imaging oil mixes with printing fluid particles, charge directors, and other print residue components remaining on the amorphous silicon photoconductor from a previous print cycle, the concentration of these residual printing components decreases. In an example, a wiper aids in the removal of this mixture from the amorphous silicon photoconductor. The wiping process may leave some of this mixture (which includes the purified imaging oil) on the amorphous silicon photoconductor. However, it has been found that this mixture includes less print residue components (e.g., polymerized charge agents) when compared to an unfiltered imaging oil, or an imaging oil filtered through an imaging oil filter alone, and thus has less of an effect or no effect on the print quality. The mixture with purified imaging oil is also easier to remove in the cleaning portion of a subsequent print cycle. While some residual printing components may also remain after the wiping process, the print quality results set forth in the Example herein indicate that a high percentage (if not 100%) of the residual printing components are removed during the cleaning portion of the methods disclosed herein.

Furthermore, the application of the purified imaging oil during the cleaning portion of the print cycle disclosed herein reduces the frequency at which a full cleaning procedure of the amorphous silicon photoconductor is performed. In some examples, a full cleaning procedure may be completely eliminated. A full cleaning procedure involves the use of chemicals and/or mechanical abrasion to clean the surface of the amorphous silicon photoconductor. Examples of chemicals used during a full cleaning procedure include ethanol, propylene, carbonate, etc. Mechanical abrasion may involve brushing the amorphous silicon photoconductor with polishing films composed of micron graded minerals, e.g., aluminum oxide, coated into a fibrous (flocked) polyester film backing. Frequent full cleanings (e.g., performed every 40,000 print cycles) can render the LEP printing apparatus non-operational more often, may damage the amorphous silicon photoconductor and reduce its lifespan, may increase apparatus consumables, and may increase the non-consumable parts included in the LEP printing apparatus. With the cleaning portion of the print cycle disclosed herein, a clean surface of the amorphous silicon photoconductor can be maintained for more print cycles, while full cleanings can be performed less often (e.g., every 200,000 print cycles) or not at all.

Figure 2:
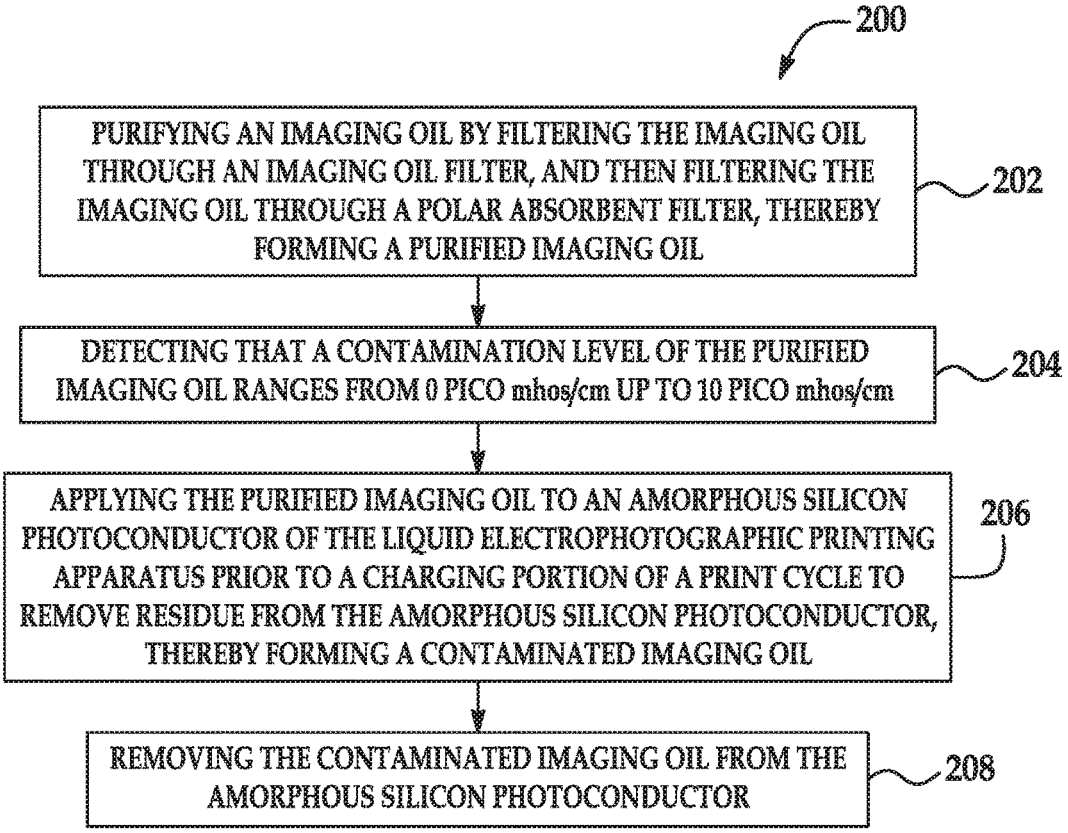
FIG. 2 is a flow diagram illustrating an example of a method for maintaining the print quality of images printed with a liquid electrophotographic printing apparatus.

An example of a method 100 for reducing contamination is shown in FIG. 1, and an example of a method 200 for maintaining print quality of images printed with an LEP printing apparatus is shown in FIG. 2.

The method 100 includes forming a purified imaging oil by filtering an imaging oil through an imaging oil filter and then filtering the imaging oil though a polar absorbent filter (reference numeral 102), and maintaining a surface of an amorphous silicon photoconductor of an LEP printing apparatus by periodically applying the purified imaging oil to the amorphous silicon photoconductor (reference numeral 104).

The method 200 includes purifying an imaging oil by filtering the imaging oil through an imaging oil filter, and then filtering the imaging oil through a polar absorbent filter, thereby forming a purified imaging oil (reference numeral 202), detecting that a contamination level of the purified imaging oil ranges from 0 pico mhos/cm up to 10 pico mhos/cm (reference numeral 204), applying the purified imaging oil to an amorphous silicon photoconductor of the LEP printing apparatus prior to a charging portion of a print cycle to remove residue from the amorphous silicon photoconductor, thereby forming a contaminated imaging oil (reference numeral 206), and removing the contaminated imaging oil from the amorphous silicon photoconductor (reference numeral 208).

Figure 3:
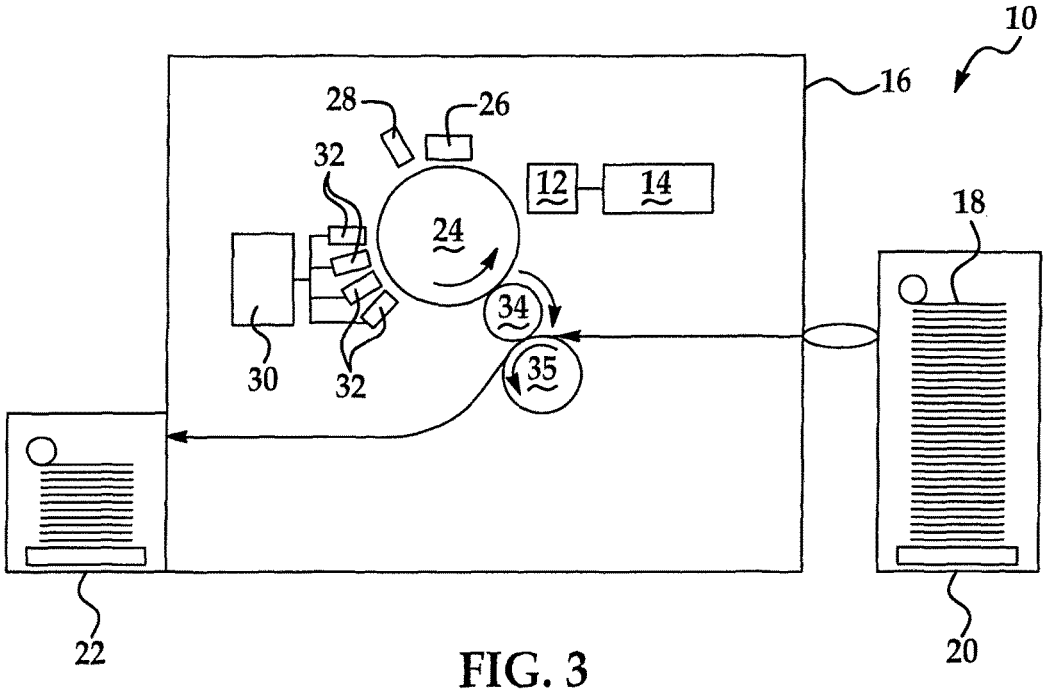
FIG. 3 is a schematic view illustrating an example of a liquid electrophotographic printing apparatus.
Figure 4:
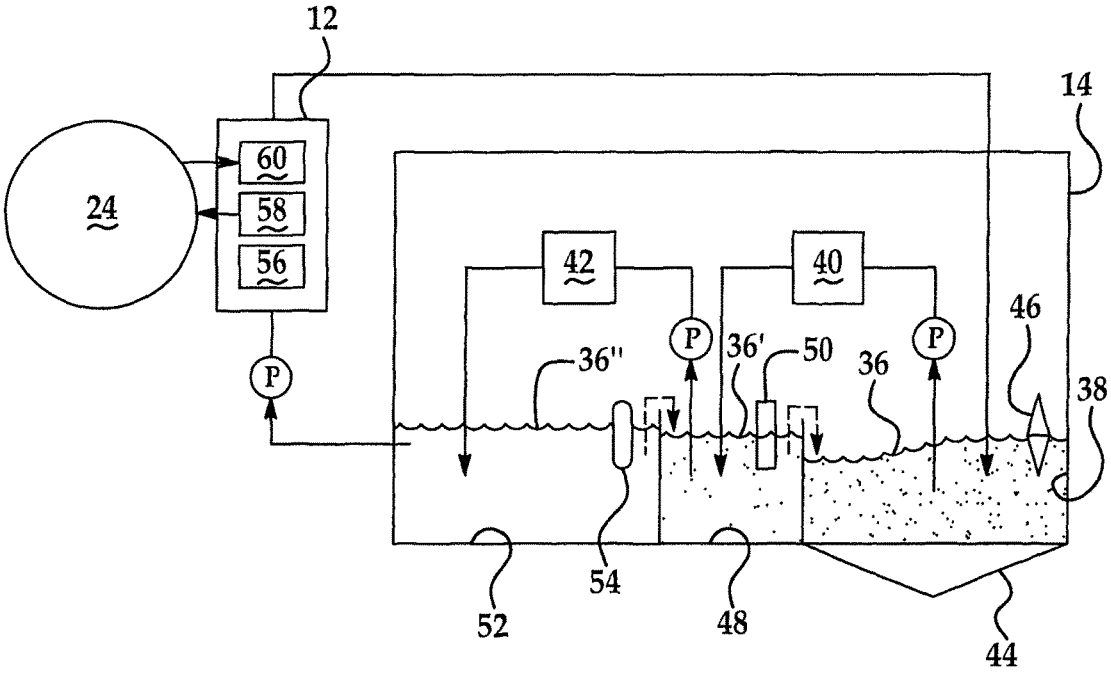
FIG. 4 is a schematic view of an example of a recycling unit in fluid communication with a cleaning station of the liquid electrophotographic printing apparatus.

Each of these example methods 100, 200 will be referenced throughout the discussion of FIG. 4, which illustrates an example of a cleaning station 12 and a recycling unit 14 of the LEP printing apparatus 10 shown in FIG. 3. In each of these methods 100, 200, a cleaning portion of the print cycle is performed when the purified imaging oil is applied to the amorphous silicon photoconductor 24 of the LEP printing apparatus 10. The cleaning portion is performed after each print or impression portion of a print cycle using the LEP printing apparatus 10, and thus the LEP printing apparatus 10 and the print or impression portion will first be described in reference to FIG. 3.

Referring now to FIG. 3, an example of the LEP printing apparatus 10 is depicted. The LEP printing apparatus 10 includes an image forming unit 16 that receives a substrate 18 from an input unit 20 and, after printing, outputs the substrate 18 to an output unit 22. The substrate 18 may be selected from any porous or non-porous substrate. Some examples of non-porous substrates include elastomeric materials (e.g., polydimethylsiloxane (PDMS)), semi-conductive materials (e.g., indium tin oxide (ITO) coated glass), or flexible materials (e.g., polycarbonate films, polyethylene films, polyimide films, polyester films, and polyacrylate films). Examples of porous substrates include coated or uncoated paper.

The image forming unit 16 of the LEP printing apparatus 10 includes the amorphous silicon photoconductor 24. The amorphous silicon photoconductor 24 has a relatively high surface resistivity, but is capable of being negatively charged with a charging system 26, such as a charge roller, a scorotron, or another suitable charging mechanism. During a print or impression cycle, the amorphous silicon photoconductor 24 is first negatively charged with the charging system 18. When charged, the amorphous silicon photoconductor 24 is very negative.

After the amorphous silicon photoconductor 24 is charged, it is rotated in the direction of a laser writing unit 28. The laser writing unit 28 is capable of selectively discharging portion(s) of the surface of the amorphous silicon photoconductor 24 that correspond to features of the image to be formed. The laser writing unit 28 is selected so that its emission can generate charges opposite to those already present on the surface of the amorphous silicon photoconductor 24. By virtue of creating such opposite charges, the laser writing unit 28 effectively neutralizes the previously formed charges at areas exposed to the emission of the laser writing unit 28. This neutralization forms an electrostatic and/or latent image on the surface of the amorphous silicon photoconductor 24. It is to be understood that those areas of the surface of the amorphous silicon photoconductor 24 not exposed to the emission of the laser writing unit 28 remain charged. In an example, the charged area(s) of the amorphous silicon photoconductor 24 is/are approximately −950 V, while the discharged or neutralized portion(s) of the amorphous silicon photoconductor 24 is/are approximately −50 V. The high resistivity of the amorphous silicon photoconductor 24 holds the charged and discharged area(s)/portion(s) in their place, which also maintains the electrostatic and/or latent image.

A controller or processor (not shown) operatively connected to the laser writing unit 28 commands the laser writing unit 28 to form the latent image. The processor is capable of running suitable computer readable instructions or programs for receiving digital images, and generating commands to reproduce the digital images using the laser writing unit 28, as well as other components of the LEP printing apparatus 10.

After the electrostatic and/or latent image is formed, the amorphous silicon photoconductor 24 is further rotated in the direction of a fluid delivery system 30. The fluid delivery system 30 supplies printing fluid to a fluid applicator 32, such as a binary ink developer (BID). The fluid delivery system 30 may include cartridge(s), an imaging oil reservoir, and printing fluid supply tank(s). The cartridges may contain differently colored concentrated pastes (e.g., ELECTROINK® from Hewlett Packard), which include printing fluid particles (e.g., colorants, etc.), charging agents (i.e., charge directors), imaging oil, and, in some instances, other dissolved materials.

The concentrated paste is fed into the printing fluid supply tank and is diluted with additional imaging oil to form a charged liquid printing fluid that is ready for printing. In an example, the charged liquid printing fluid is negatively charged.

The charged liquid printing fluid is delivered to the fluid applicator 32, which provides the charged liquid printing fluid to the electrostatic and/or latent image on the amorphous silicon photoconductor 24 to form a fluid image. In an example, a roller in each of the BIDs (one example of applicator 32) is used to deposit a uniform layer of the charged liquid printing fluid onto electrostatic and/or latent image on the surface of the amorphous silicon photoconductor 24 during image development.

The fluid image is then transferred from the amorphous silicon photoconductor 24 to an intermediate (or image) transfer blanket (or member) 34 through temperature differences and the use of pressure. The intermediate transfer blanket 34 receives the fluid image from the amorphous silicon photoconductor 24 and heats the fluid image (which evaporates at least some of the imaging oil from the fluid image to form a solid film image). The intermediate transfer blanket 34 transfers the solid film image (which may include some residual imaging oil) to the substrate 18. The substrate is brought directly into contact with the intermediate transfer blanket 34 via an impression member 35, in order to transfer the solid film image to the substrate 18. After the solid film image is transferred to the substrate 18, the substrate 18 is transported to the output unit 22.

After the solid film image is transferred to the substrate 18, some of the charged liquid printing fluid may remain on the surface of the amorphous silicon photoconductor 24. The amorphous silicon photoconductor 24 is further rotated so that it can be exposed to the cleaning portion of the print cycle disclosed herein.

The cleaning portion of the print cycle utilizes the cleaning station 12 and the recycling unit 14 of the image forming unit 16. The cleaning portion of the print cycle will be discussed now in reference to FIG. 4, as well as FIGS. 1 and 2.

To perform the cleaning portion of the print cycle, a purified imaging oil 36" is applied to the surface of the amorphous silicon photoconductor 24 (reference numeral 104 in FIG. 1 and reference numeral 206 in FIG. 2). Prior to this application, however, the purified imaging oil 36" is formed in the recycling unit 14.

To form the purified imaging oil 36", an imaging oil 36 present in a first reservoir or compartment 38 of the recycling unit 14 is filtered through multiple filters consecutively. The imaging oil 36 may be a combination of imaging oil that is introduced directly into the reservoir 38, as well as imaging oil and fluid residue that is removed, by the cleaning station 12, from the amorphous silicon photoconductor 24 after the print/impression portion of the print cycle. The imaging oil that is introduced directly into the reservoir 38 and the imaging oil that is removed from the amorphous silicon photoconductor 24 after the print/impression portion of the print cycle may be the same or at least compatible with one another. In FIG. 4, the fluid residue (which may include, e.g., charging agents, printing fluid particles, other dissolved materials, etc.) is shown as speckles.

The imaging oil 36 may be a hydrocarbon, examples of which include isoparaffinic hydrocarbons, paraffinic hydrocarbons, aliphatic hydrocarbons, de-aromatized hydrocarbons, halogenated hydrocarbons, cyclic hydrocarbons, and combinations thereof. The hydrocarbon may be an aliphatic hydrocarbon, an isomerized aliphatic hydrocarbon, branched chain aliphatic hydrocarbons, aromatic hydrocarbons, and combinations thereof. Some examples of the imaging oil 36 include ISOPAR® G, ISOPAR® H, ISOPAR® K, ISOPAR® L (as previously mentioned), ISOPAR® M, ISOPAR® V, NORPAR® 12, NORPAR® 13, NORPAR® 15, EXXOL® D40, EXXOL® D80, EXXOL® D100, EXXOL® D130, and EXXOL® D140, all of which are available from Exxon-Mobil Corp., Houston, Tex.

The reservoir 38 may include a drain 44 for particles present in the imaging oil 36 that are heavy or big. Heavy or big particles may include particles having a size up to 50 microns. These particles may settle at the bottom of the reservoir 38 and then may be removed through the drain 44.

The reservoir 38 may also have a level switch 46 positioned therein in contact with the imaging oil 36. The level switch 46 may switch on when a predetermined level of the imaging oil 36 is reached in the reservoir 38. The level switch 46 is capable of detecting and communicating to a fluid addition unit (not shown) that a predetermined fluid level has been reached. In response, the fluid addition unit can add supplemental imaging oil 36 to the waste reservoir 38.

To form the purified imaging oil 36", the imaging oil 36 in the first reservoir 38 is pumped (via one of the pumps P) to and through the imaging oil filter 40 (reference numerals 102 of FIGS. 1 and 202 of FIG. 2), and then into the second reservoir or compartment 48. The imaging oil filter 40 may be any mechanical filter of 2 micron particles which removes printing fluid particles that have a particle size of 2 microns or greater. The mechanical filter may absorb the particles, screen the particles from passing through, or utilize any other suitable filtering mechanism. In an example, the imaging oil filter 40 is a mesh screen having openings that are about 2 microns.

The imaging oil filter 40 helps to maintain the lifespan of the polar absorbent filter 42. If directed through the polar absorbent filter 42, these printing fluid particles would occupy at least some of the cells of the polar absorbent filter 42. In the examples disclosed herein, the imaging oil filter 40 keeps these printing fluid particles from reaching the polar absorbent filter 42, and thus the cells of the polar absorbent filter 42 remain unoccupied to absorb polar molecules, such as the charging agents.

The imaging oil that is obtained after filtration through the imaging oil filter 40 is a filtered imaging oil 36'. The filtered imaging oil 36' is directed into a second reservoir 48 of the recycling unit 14. The reservoir 48 may have a density sensor 50 positioned therein in contact with the filtered imaging oil 36'. The density of the filtered imaging oil 36' may correspond to a dirtiness level of the fluid in the reservoir 48. The density sensor 50 is capable of detecting when a predetermined density value is achieved. The predetermined density value may correspond to an upper limit of an acceptable dirtiness level (or a lower limit of an unacceptable dirtiness level) of the filtered imaging oil 36', and may indicate that the then-current imaging oil filter 40 needs to be cleaned or replaced. The density sensor 50 may inform a user of the LEP printing apparatus 10 that the imaging oil filter 40 needs to be cleaned or changed prior to the dirtiness level of the filtered imaging oil 36' reaching an unacceptable level. An example of the predetermined density value may be an optical density value of 0.1.

When the density reading indicates that the fluid in the reservoir 48 is not suitably filtered, the reservoir 48 may include a conduit or another mechanism that can transfer the fluid back into the reservoir 38. For example, if the density value corresponds to the lower limit of the acceptable dirtiness level, the imaging oil in the reservoir 48 may be transferred back to the reservoir 38 and rerun through the imaging oil filter 40.

The filtered imaging oil 36' in the second reservoir 48 is pumped (via one of the pumps P) to and through the polar absorbent filter 42 (reference numerals 102 of FIGS. 1 and 202 of FIG. 2), and then into a third reservoir or compartment 52. The polar absorbent filter 42 may be any filter that is capable of absorbing polymer molecules, such as the negative charging agents in the fluid residue. Examples of the polar absorbent filter 42 include a silica gel filter and a carbon filter (e.g., activated carbon). While other polar absorbent filters may be used, in one example, the filter 42 is selected from the group consisting of the silica gel filter and the carbon filter.

The imaging oil that is obtained after filtration through the polar absorbent filter 42 is the purified imaging oil 36". The purified imaging oil 36" is directed into a third reservoir 52 of the recycling unit 14. The reservoir 52 may have a conductivity meter 54 positioned therein in contact with the purified imaging oil 36". The conductivity of the purified imaging oil 36" corresponds with a contamination level of the purified imaging oil 36". A lower conductivity is indicative of a lower contamination level, which is indicative of the absence, or a minimal amount, of charging agent in the purified imaging oil 36". In the examples disclosed herein, the purified imaging oil 36" is considered to be pure when the conductivity (or contamination level) ranges from 0 pico mhos/cm up to 10 pico mhos/cm. In another example the conductivity of contamination level of the purified imaging oil 36" is less than 5 pico mhos/cm.

As shown at reference numeral 204 in FIG. 2, in the example method 200, the contamination level of the purified imaging oil 36" is detected before applying the purified imaging oil 36" in the cleaning portion of the print cycle. Contamination level detection may also be performed between reference numerals102 and 104 of the method 100 in FIG. 1. When the conductivity meter 54 indicates that the contamination level corresponds with a reading ranging from 0 pico mhos/cm up to 10 pico mhos/cm, the purified imaging oil 36" may then be applied to the amorphous silicon photoconductor 24.

In contrast, a conductivity meter reading above 10 pico mhos/cm indicates that the then-current polar absorbent filter 42 needs to be cleaned or replaced, and/or that the imaging oil in the reservoir 52 is not purified. The conductivity meter 54 may inform a user of the LEP printing apparatus 10 that the polar absorbent filter 42 needs to be cleaned or changed, and/or that the imaging oil in the reservoir 52 should not be used in the cleaning portion of the print cycle.

When the conductivity meter reading is above 10 pico mhos/cm, the reservoir 52 may also include a conduit or another mechanism that can transfer the imaging oil in the reservoir 52 back into the reservoir 48. The imaging oil 36' may then be rerun through the polar absorbent filter 42 in order to obtain the purified imaging oil 36".

The purified imaging oil 36" may then be applied to the amorphous silicon photoconductor 24 during the cleaning portion of the print cycle. In the example method 100 (reference numeral 104), the purified imaging oil 36" is applied periodically (e.g., as the last portion of one print cycle and prior to the beginning of the next print cycle) in order to maintain the cleanliness and surface resistivity of the amorphous silicon photoconductor 24. In the example method 200 (reference numeral 204), the purified imaging oil 36" is applied prior to the charging portion (e.g., a charge cycle via the charging system 26) of the next print cycle.

In both example methods 100, 200, the cleaning system 12 may be used to apply the purified imaging oil 36" to the amorphous silicon photoconductor 24. The cleaning system 12 may be fluidly connected to the recycling unit 14 via a conduit, and a pump (one of the pumps P in FIG. 4) may be used to deliver the purified imaging oil 36".

The cleaning system 12 may include a cooling unit 56, an applicator unit 58, and a removal unit 60. The cooling unit 56 is capable of receiving and cooling the purified imaging oil 36" from the reservoir 52 to be applied to the amorphous silicon photoconductor 24. In an example, the cooling unit 56 provides the cooled purified imaging oil 36" to the applicator unit 58. The cooling unit 56 may include a heat exchanger and/or a chamber having tubes transporting cold water, or the like, therethrough and in contact with the purified imaging oil 36" to be cooled.

The applicator unit 58 is programmed to apply the purified imaging oil 36" to the amorphous silicon photoconductor 24 after the print or impression portion of the print cycle is complete (i.e., the solid film image is transferred to the substrate 18). The applicator unit 58 may include a pressure unit and a conduit to pressurize and direct the purified imaging oil 36" to be applied to the amorphous silicon photoconductor 24 therethrough. As examples, the pressure unit may include a pump, such as a piston-based apparatus and/or a pressure-assisted can, or the like. The applicator unit 58 may include a mechanical component for applying the purified imaging oil 36", such as brushes, sponges (e.g., a sponge roller), etc.

The surface of the amorphous silicon photoconductor 24 that is to be exposed to the purified imaging oil 36" has been through the portions of the print cycle described in reference to FIG. 3, and thus may have fluid residue thereon. Fluid residue may include a portion of the charged liquid printing fluid (that had been transferred to the latent image) that remains on the amorphous silicon photoconductor 24 after the transfer of the fluid image from the amorphous silicon photoconductor 24 to the intermediate transfer blanket 34. As such, the fluid residue may include imaging oil, charging agent, printing fluid particles, etc.

When the purified imaging oil 36" is applied to the amorphous silicon photoconductor 24 and the fluid residue thereon, the purified imaging oil 36" mixes with and dilutes the fluid residue. This mixture is referred to as a contaminated imaging oil, but it is to be understood that some of this mixture is still the purified imaging oil 36".

The removal unit 60 is capable of subsequently removing the contaminated imaging oil from the amorphous silicon photoconductor 24. The removal unit 60 may include a wiper, a catch basin, and/or a conduit. The wiper may wipe the contaminated imaging oil from the amorphous silicon photoconductor 24. The catch basin may catch the contaminated imaging oil removed from the amorphous silicon photoconductor 24. The conduit may transport the contaminated imaging oil from the amorphous silicon photoconductor 24 to the reservoir 38 of the recycling unit 14 for re-purification (through the imaging oil filter 40 and then the polar absorbent filter 42).

It is to be understood that most of the contaminated imaging oil is removed from the amorphous silicon photoconductor 24 via the removal unit 60. However, some of the contaminated imaging oil (i.e.; purified imaging oil 36" and fluid residue) may remain on the surface of the amorphous silicon photoconductor 24 even after removal is complete. It is to be understood that, after removal, the level of fluid residue that remains on the amorphous silicon photoconductor 24 is much less than the level of fluid residue that would be present on the amorphous silicon photoconductor 24 had the purified imaging oil 36" not been applied. Since the fluid residue level on the amorphous silicon photoconductor 24 is much less, there is little or no deleterious effect on the print quality during subsequent print cycles. Additionally, since the remaining fluid residue also includes the purified imaging oil 36", it is easier to remove during the cleaning portion of a subsequent print cycle.

Another print cycle may then be performed, and following the print/impression portion, the cleaning portion of the print cycle will be performed in order to clean the amorphous silicon photoconductor 24 and maintain the surface resistivity of the amorphous silicon photoconductor 24. The cleaning portion of the print cycle may include purifying the imaging oil 36, in some instances, detecting the contamination level of the purified imaging oil 36", applying the purified imaging oil 36" to the amorphous silicon photoconductor 24, and removing the contaminated imaging oil (i.e., purified imaging oil 36" plus fluid residue from the photoconductor 24).

As mentioned herein, a full cleaning procedure may be performed at least 200,000 print/impression cycles after the initial print cycle of the LEP printing apparatus 10. In one example, this process is performed manually by a user of the LEP printing apparatus 10. In another example, the LEP printing apparatus 10 may include or be operatively connected to a maintenance apparatus (not shown), which includes a chemical supply that automatically supplies cleaning chemicals to the surface of the amorphous silicon photoconductor 24, and a mechanical cleaning component, such as a polishing film, etc., that automatically scrubs the amorphous silicon photoconductor 24. As mentioned above, with the addition of the cleaning portion in the print cycles disclosed herein, the full cleaning procedure may not be performed.

To further illustrate the present disclosure, an example is given herein. It is to be understood that this example is provided for illustrative purposes and is not to be construed as limiting the scope of the present disclosure.

EXAMPLE

A silica gel filter was tested to determine an estimated life expectancy of the filter. The silica gel filter was tested using a 10 L reservoir. A negative charging agent was added in 30 g to 40 g doses, bringing the low field conductivity to about_100 pMhos/cm. The low field conductivity measurements were performed under a low voltage relative to the high voltage that is used during printing fluid development. In two tests, the capacity measured was 350 g of charging agent.

According to measurements of conductivity buildup during actual printing, the life expectancy of the silica gel filter was calculated to be 750,000 print cycles/impressions on a press per 8 inches of silica gel filter and a flow rate of 8 liters per minute. The life expectancy calculation was based on the field average and offline tests of the silica gel absorbent capacity.

750,000 print cycles were performed in both an example printing process and a comparative example printing process. An LEP printing apparatus was used and HP Indigo ELECTROINK® was used.

Figure 5A:
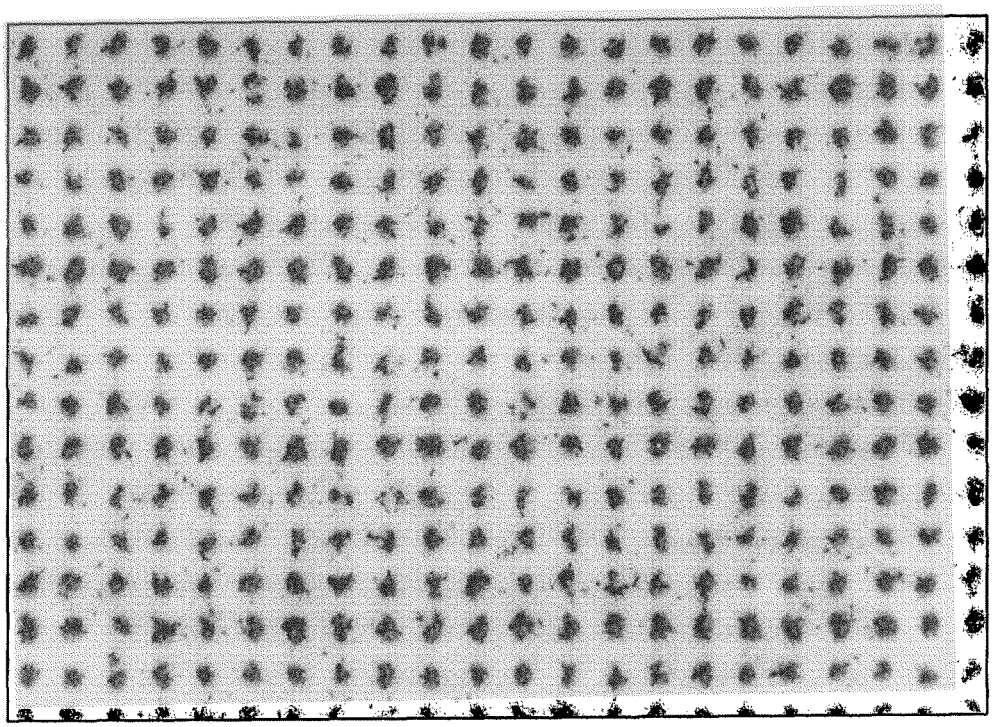
FIG. 5A is a photograph of a print formed with a liquid electrophotographic printing apparatus including an amorphous silicon photoconductor that was maintained with purified imaging oil via an example of the methods disclosed herein.

After each print cycle in the example printing process, the amorphous silicon photoconductor was exposed to purified ISOPAR® L, which had been filtered through a mesh screen and the silica gel filter. Prior to its exposure to the amorphous silicon photoconductor, the conductivity of the purified ISOPAR® L was measured and found to continuously range from 0 pico mhos/cm to 10 pico mhos/cm. After each exposure, purified ISOPAR® L and filter residue were removed from the amorphous silicon photoconductor, and then a subsequent print cycle was performed. FIG. 5A is a photograph of the print that was formed after the 750,000 print cycle of the example printing process.

Figure 5B:
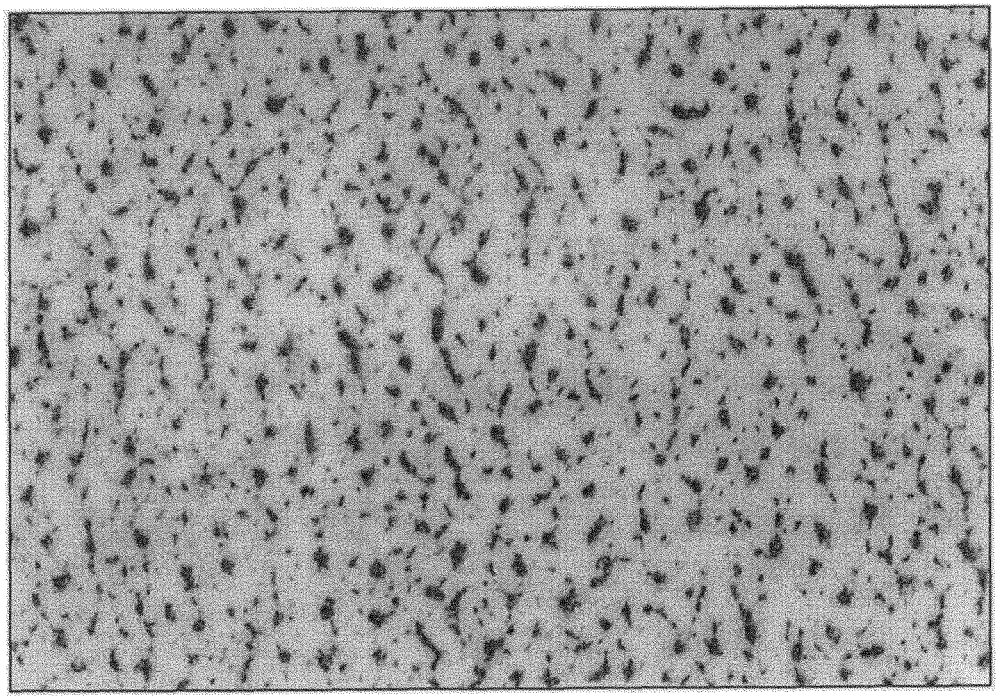
FIG. 5B is a photograph of a comparative print formed with a liquid electrophotographic printing apparatus including an amorphous silicon photoconductor that was exposed to a contaminated imaging oil.

After each print cycle in the comparative example printing process, the amorphous silicon photoconductor was exposed to unpurified ISOPAR® L, which included negative charging agents. After each exposure, the unpurified ISOPAR® L and filter residue were removed from the amorphous silicon photoconductor, and then a subsequent print cycle was performed. In this comparative example, prior to the 750,000th print cycle, the conductivity of the unpurified ISOPAR® L was measured and found to be 200 pico mhos/cm. FIG. 5B is a photograph of the comparative print that was formed after the 750,000 print cycle of the comparative example printing process.

In comparing FIGS. 5A and 5B, the print quality of the example print formed via the example printing process (using purified imaging oil) was much better than the print quality of the comparative example print formed via the comparative example printing process (using unpurified imaging oil). The high resolution of the small dots was maintained in FIG. 5A, whereas the dots in FIG. 5B are smeared. Clearly, the purified ISOPAR® L cleaned the surface of the amorphous silicon photoconductor, which maintained the surface resistivity and print quality even after 750,000 print cycles. In contrast, the unpurified ISOPAR® L introduced residual charging agents to the surface of the amorphous silicon photoconductor, which polymerized during the subsequent print cycles and accumulated on the surface of the amorphous silicon photoconductor. This accumulation changed the surface electrical properties, and in fact, led to high lateral conductivity on the surface of the amorphous silicon photoconductor. The high lateral conductivity affected the charging and discharging during printing and resulted in poor print quality prints.

It is to be understood that the ranges provided herein include the stated range and any value or sub-range within the stated range. For example, a range from about 5,000,000 print cycles to about 7,000,000 print cycles should be interpreted to include the explicitly recited limits of about 5,000,000 print cycles to about 7,000,000 print cycles, as well as individual values, such as 6,500,000 print cycles, 5,250,000 print cycles, 5,000,500 print cycles, etc., and sub-ranges, such as from about 5,500,000 print cycles to about 6,250,000 print cycles, from about 5,000,250 print cycles to about 6,000,250 print cycles, etc. Furthermore, when "about" is utilized to describe a value, this is meant to encompass minor variations (up to +/−10%) from the stated value.

Reference throughout the specification to "one example", "another example", "an example", and so forth, means that a particular element (e.g., feature, structure, and/or characteristic) described in connection with the example is included in at least one example described herein, and may or may not be present in other examples. In addition, it is to be understood that the described elements for any example may be combined in any suitable manner in the various examples unless the context clearly dictates otherwise.

In describing and claiming the examples disclosed herein, the singular forms "a", "an", and "the" include plural referents unless the context clearly dictates otherwise.

While several examples have been described in detail, it is to be understood that the disclosed examples may be modified. Therefore, the foregoing description is to be considered non-limiting.

What is claimed is:

1. A liquid electrophotographic printing apparatus, comprising:

an amorphous silicon photoconductor;

a cleaning station to selectively periodically apply a purified imaging oil to the amorphous silicon photoconductor and to remove contaminated imaging oil from the amorphous silicon photoconductor; and a recycling unit in fluid communication with the cleaning station, the recycling unit including:

a first compartment to receive the contaminated imaging oil from the cleaning station, the contaminated imaging oil including printing fluid particles and polar molecules;

an imaging oil filter to receive the contaminated imaging oil from the first compartment and to remove at least some of the printing fluid particles to form a filtered imaging oil;

a second compartment to receive the filtered imaging oil from the imaging oil filter;

a density sensor disposed in the second compartment to detect an optical density of the filtered imaging oil in the second compartment;

a first conduit in fluid communication with the first compartment to selectably convey the filtered imaging oil from the second compartment to the first compartment wherein the selectable conveyance is based on the optical density of the filtered imaging oil detected by the density sensor;

a polar absorbent filter to receive the filtered imaging oil from the second compartment and to remove the polar molecules to form the purified imaging oil;

a third compartment to receive the purified imaging oil from the polar absorbent filter, wherein the cleaning station is to receive the purified imaging oil from the third compartment; and a conductivity meter positioned in the third compartment, the conductivity meter to detect a conductivity corresponding to a contamination level of the purified imaging oil, wherein the selective periodic application of the purified imaging oil by the cleaning station is in response to a detection of the conductivity corresponding to the contamination level of the purified imaging oil being less than a threshold value.

2. The liquid electrophotographic printing apparatus as defined in claim 1 wherein:

the imaging oil filter is a mechanical filter of 2 micron particles; and the polar absorbent filter is a silica gel filter or a carbon filter.

3. The liquid electrophotographic printing apparatus as defined in claim 1, further comprising a charging system, a fluid delivery system, and a fluid applicator.

4. The liquid electrophotographic printing apparatus as defined in claim 1 wherein the cleaning station includes:

a cooling unit in fluid communication with the third compartment, the cooling unit to receive the purified imaging oil from the third compartment and to cool the purified imaging oil from the third compartment.

5. The liquid electrophotographic printing apparatus as defined in claim 4 wherein the cooling unit includes:

a heat exchanger having tubes transporting a coolant therethrough, the tubes being in contact with the purified imaging oil to cool the purified imaging oil.

6. The liquid electrophotographic printing apparatus as defined in claim 4 wherein the cleaning station further includes:

an applicator unit to received the cooled purified imaging oil from the cooling unit and to apply the cooled purified imaging oil to the amorphous silicon photoconductor after an impression portion of the print cycle is complete, the applicator unit having a pressure unit to pressurize the cooled purified imaging oil, and a second conduit to direct the cooled purified imaging oil to the amorphous silicon photoconductor, the applicator unit having a brush or sponge for applying the cooled purified imaging oil to the amorphous silicon photoconductor.

7. The liquid electrophotographic printing apparatus as defined in claim 4 wherein the cleaning station further includes:

a removal unit to remove the contaminated imaging oil from the amorphous silicon photoconductor, the removal unit including:

a wiper to wipe the contaminated imaging oil from the amorphous silicon photoconductor;

a catch basin to catch the contaminated imaging oil removed from the amorphous silicon photoconductor ; and a third conduit to transport the contaminated imaging oil from the amorphous silicon photoconductor to the first compartment of the recycling unit for repurification.

8. The liquid electrophotographic printing apparatus as defined in claim 1, further comprising:

a first common wall shared by the first compartment and the second compartment, the first common wall retaining the filtered imaging oil in the second compartment up to a first overflow level, wherein filtered imaging oil above the first overflow level flows over the first common wall into the first compartment;

a second common wall shared by the second compartment and the third compartment, the second common wall retaining the purified imaging oil in the third compartment up to a second overflow level, wherein the purified imaging oil above the second overflow level flows over the second common wall into the second compartment, wherein the second overflow level is above the first overflow level thereby preventing the filtered imaging oil from flowing over the second common wall into the third compartment without having been filtered by the polar absorbent filter.

9. The liquid electrophotographic printing apparatus as defined in claim 1 wherein the first compartment is to selectably convey the filtered imaging oil from the second compartment to the first compartment when the optical density of the filtered imaging oil detected by the density sensor is greater than 0.1.

10. A liquid electrophotographic printing apparatus, comprising:

an amorphous silicon photoconductor;

a cleaning station to selectively periodically apply a purified imaging oil to the amorphous silicon photoconductor and to remove contaminated imaging oil from the amorphous silicon photoconductor; and a recycling unit in fluid communication with the cleaning station, the recycling unit including:

a first compartment to receive the contaminated imaging oil from the cleaning station, the contaminated imaging oil including printing fluid particles and polar molecules;

an imaging oil filter to receive the contaminated imaging oil from the first compartment and to remove at least some of the printing fluid particles to form a filtered imaging oil;

a second compartment to receive the filtered imaging oil from the imaging oil filter;

a density sensor disposed in the second compartment to detect an optical density of the filtered imaging oil in the second compartment, wherein the density sensor is to inform a user of the liquid electrophotographic printing apparatus that the imaging oil filter requires service when the optical density of the filtered imaging oil in the second compartment detected by the density sensor is in a predetermined range;

a polar absorbent filter to receive the filtered imaging oil from the second compartment and to remove the polar molecules to form the purified imaging oil;

a third compartment to receive the purified imaging oil from the polar absorbent filter, wherein the cleaning station is to receive the purified imaging oil from the third compartment; and a conductivity meter positioned in the third compartment, the conductivity meter to detect a conductivity corresponding to a contamination level of the purified imaging oil, wherein the selective periodic application of the purified imaging oil by the cleaning station is in response to a detection of the conductivity corresponding to the contamination level of the purified imaging oil being less than a threshold value.

11. The liquid electrophotographic printing apparatus as defined in claim 10 wherein the recycling unit further includes:

a first conduit in fluid communication with the first compartment to selectably convey the filtered imaging oil from the second compartment to the first compartment wherein the selectable conveyance is based on the optical density of the filtered imaging oil detected by the density sensor.

12. The liquid electrophotographic printing apparatus as defined in claim 11 wherein:

the imaging oil filter is a mechanical filter of 2 micron particles; and the polar absorbent filter is a silica gel filter or a carbon filter.

13. The liquid electrophotographic printing apparatus as defined in claim 11, further comprising a charging system, a fluid delivery system, and a fluid applicator.

14. The liquid electrophotographic printing apparatus as defined in claim 11 wherein the cleaning station includes:

a cooling unit in fluid communication with the third compartment, the cooling unit to receive the purified imaging oil from the third compartment and to cool the purified imaging oil from the third compartment.

15. The liquid electrophotographic printing apparatus as defined in claim 14 wherein the cooling unit includes:

a heat exchanger having tubes transporting a coolant therethrough, the tubes being in contact with the purified imaging oil to cool the purified imaging oil.

* * * * *